United States Patent [19]

Handen et al.

[11] 4,221,376

[45] Sep. 9, 1980

[54] DOCUMENT CARTRIDGE AND MOUNTING APPARATUS

[75] Inventors: Carl Handen; Don S. Minami, both of Los Gatos; John D. Treder, Santa Clara, all of Calif.

[73] Assignee: International Business Machines Corporation, Armonk, N.Y.

[21] Appl. No.: 882,001

[22] Filed: Feb. 28, 1978

[51] Int. Cl.[3] ..... B65H 1/02; B65H 1/10; B65H 7/04

[52] U.S. Cl. ..... 271/149; 221/14; 221/17; 221/151; 221/154; 221/198; 221/226; 221/287; 271/34; 271/9; 271/162; 271/256; 271/160

[58] Field of Search ..... 271/34, 162–164, 271/149, 150, 122, 30 A, 126, 129, 35, 160, 256, 258, DIG. 3, 9, 145; 221/197, 198, 287, 4, 6, 14, 17, 52, 56–60, 226, 231, 279, 280, 151, 154; 235/379, 381; 194/DIG. 26; 214/301; 209/909; 414/403

[56] References Cited

U.S. PATENT DOCUMENTS

| | | | |
|---|---|---|---|
| 2,652,248 | 9/1953 | Johnson | 271/149 X |
| 3,035,834 | 5/1962 | Bottrell . | |
| 3,123,082 | 3/1964 | Call et al. . | |
| 3,297,372 | 1/1967 | Brader . | |
| 3,868,044 | 2/1975 | Abe et al. | 221/6 |
| 3,937,925 | 2/1976 | Boothroyd . | |
| 3,957,366 | 5/1976 | Taylor et al. | 271/164 X |
| 4,106,667 | 8/1978 | Lynott | 221/1 |
| 4,113,140 | 9/1978 | Graef et al. | 221/6 |

FOREIGN PATENT DOCUMENTS

| | | |
|---|---|---|
| 50-91400 | 7/1975 | Japan . |
| 50-94997 | 7/1975 | Japan . |

OTHER PUBLICATIONS

Laybourn, R. J. et al., "Currency Cartridge", *IBM Technical Disclosure Bulletin,* vol. 18, No. 1, Jun. 1975. p. 237.

Lynott, J. J., "Currency Cartridge", *IBM Technical Disclosure Bulletin,* vol. 19, No. 2, Jul. 1976. pp. 664–665.

Lynott, J. J. et al., "Currency Feed Mechanism", *IBM Technical Disclosure Bulletin,* vol. 20, No. 2, Jul. 1977. pp. 758–759.

Hansen, R. L. et al., "Media Cartridge", *IBM Technical Disclosure Bulltin,* vol. 20, No. 8, Jan. 1978. pp. 3303–3304.

Operating Instruction Manual, Omron Casa Dispenser Model YM-LT-01.

"The Next Generation of Cash Dispenser, The I-I", Inter Innovation AB., Stockholm, Sweden.

"Lifetime Test Carried Out On Modm Project", Inter Innovation AB., Stockholm, Sweden. Mar. 1977.

*Primary Examiner*—Bruce H. Stoner, Jr.

*Attorney, Agent, or Firm*—Shelley M. Beckstrand

[57] ABSTRACT

A portable cartridge and mounting apparatus includes, within the cartridge, a document separator, a stack follower, a double document restraint, and a three position lock and latch mechanism for selectively locking the cartridge cover and the issue slot. The mounting includes first and second drives for operating the separator and restraint mechanisms to issue individual documents through the issue slot. The mounting and cartridge are keyed to detect that a cartridge containing a predetermined denomination is properly mounted with the issue slot open to enable the drive mechanisms. A sensor is provided to detect a cash out condition to inhibit operation of the drives.

15 Claims, 12 Drawing Figures

DOCUMENT CARTRIDGE AND MOUNTING APPARATUS

DESCRIPTION

1. Cross References

Application Ser. No. 882,007 filed Feb. 28, 1978, now abandoned, entitled Document Handling Mechanism by D. D. Decker and R. L. Hansen, of common assignee.

Application Ser. No. 882,010 filed Feb. 28, 1978, now abandoned, entitled Document Handling Mechanism by R. J. Laybourn, of common assignee.

2. Technical Field

This invention relates to an article dispensing mechanism and mount therefor which operates to apply a force to operate an article discharging instrumentality, with separate means for removing that force in response to sensing depletion of the supply of articles, or to sensing the dispensing mechanism is improperly fastened to the support. More particularly, the invention relates to a document cartridge and dispenser mounting apparatus, the mounting apparatus including force applying means for operating the cartridge discharging apparatus enabled by means sensing that the cartridge is properly mounted and the issue door opened, and disabled by means sensing depletion of documents in the cartridge.

3. Background Art

Automatic Teller Machines (ATM) are provided in the prior art, which include among their many functions the dispensing of currency documents to the individual authorized to receive such.

Currency documents have severely variable characteristics due to age, country, condition, environmental conditions, and so forth. These variable characteristics between currency types by denomination and country, and between individual documents within a type make it extremely difficult to design a single mechanism which can handle (store, separate, feed) any type of document, and all documents of a given type.

Prior art ATM currency dispensers are provided which issue prepackaged bundles of documents. While these overcome the difficulties associated with handling documents of widely varying characteristics, they do not provide the flexibility of issuing cash in any amount (divisible by the denomination of the currencies issued.)

Other prior art ATM currency dispensers provide mechanisms for separating individual documents from a stack of documents loaded into a hopper in the ATM. Many document separation techniques, including vacuum picking, have been incorporated in prior art currency dispensers, one of the most satisfactory of which provides a friction separator belt for feeding a document off of the end of the stack, and a reversibly driven restraint belt for preventing the second endmost document from issuing with the endmost (a "double feed" error.) Such a dispensing mechanism is described in U.S. Pat. No. 3,937,925. These currency dispensers require the loading of loose stacks of documents into the terminals, which are often placed remote from the secure environment of a bank—requiring that individuals transport the currency thereto, and then properly load them into the terminal hopper.

It has been suggested that currency documents be loaded into semi-secure containers for distribution from a container loading location to the remote automatic teller terminals (ATM), and that the documents be removed from that container as individual sheets for delivery to the ATM operator. A severe problem has been the difficulty of removing individual sheets from such a container without jamming in the container or transport external of the container, and without double feeds (two or more sheets adhered together.) Another severe problem results when, in the course of removing individual sheets from such a container, following sheets extend slightly through the issue door or port for subsequent removal—and so extend when it is desired to remove the container from the ATM: the partially removed sheets may be left behind in the ATM transport, or exposed for easy surreptitious removal from the container.

The foregoing are merely representative of the many problems associated with the handling of currency documents, or sheets, of widely varying characteristics in unattended automatic teller machines.

The apparatus of the invention includes a document cartridge adapted for mounting in an automatic teller machine, wherein the cartridge comprises latching means for selectively locking and opening issue and load ports in a wall of the container and keying means settable to characterize the currency denomination; and wherein the teller machine comprises switching means responsive to said latching means opening said issue port, and to said keying means, for enabling the issuance of documents from said container into said teller machine.

The invention further provides means for inhibiting further issuance of documents from said container in response to detecting that the number of sheets remaining in said container is less than a predetermined number.

DISCLOSURE OF INVENTION

Figure 1:
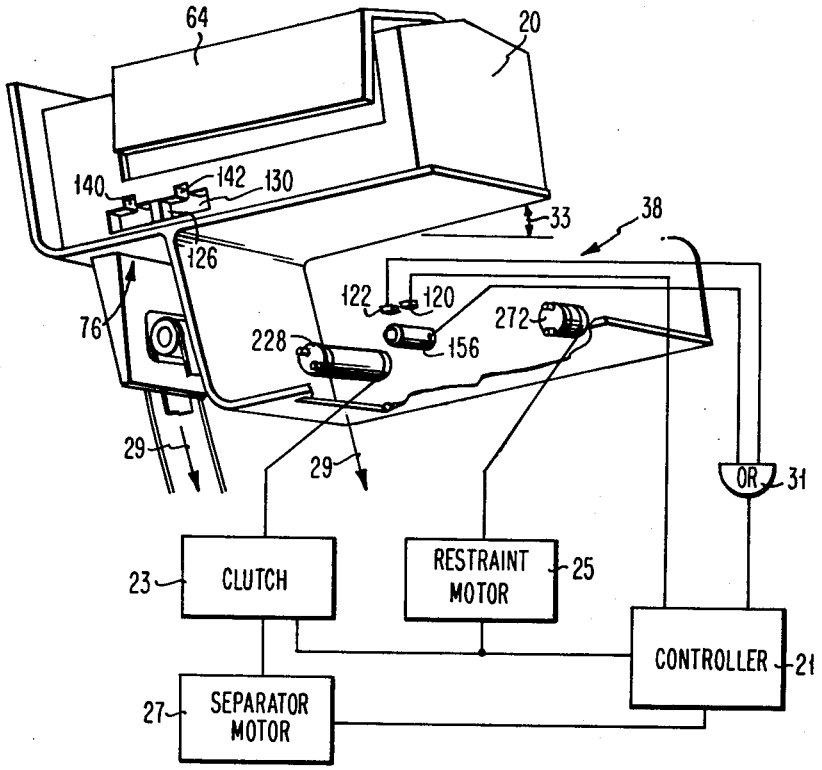
FIG. 1 is a schematic view of the document feed mechanism (DFM) of an automatic teller machine (ATM) illustrating the cartridge loading and controlling apparatus.

Referring now to FIG. 1, a description will be given of the document cartridge mounting mechanisms of the invention. Reference is made to U.S. Pat. No. 3,937,925 for a description of a modular transaction terminal with microprocessor control which, as is apparent to those skilled in the art, may be adapted for use with the document cartridge of the present invention in accordance with the description hereinafter provided.

Portable cartridge 20 is utilized for loading, transporting, and issuing currency or other document sheets. Cartridges 20 are interchangeable between automatic teller machines (ATM) with the document feed mechanism base assembly of one such ATM adapted for two cartridges 20 (one being shown) represented generally as assembly 38 in FIG. 1, together with the control circuitry for one cartridge (at the position not showing a cartridge in place.)

As will be more completely described hereafter, cartridge 20 includes the following assemblies for separating and delivering individual sheets from a stack held securely within the cartridge: follower 22, cash low/-cash out sensors 24, feed door assembly 26, cartridge in place keying means 28, document meter 30, separator 32, and restraint 34. Some of these assemblies cooperate with mating or coupled mechanisms in ATM 38.

Individual sheets are delivered from cartridge 20 into transport 29 of document feed mechanism 38. While not forming a part of this invention, a document transport 29 adaptable for use with the document feed mechanism 38 and cartridge 20 of the present invention is described in U.S. Pat. No. 4,150,757 by J. Lynott and R. Laybourn for a Plural Document Stacking and Subsequent Selective Stack Transporting Apparatus.

Controller 21 operates in a manner similar to that in the aforementioned U.S. Pat. No. 3,937,925 to control the delivery of individual sheets from stacks of documents. Herein, however, as the stacks are enclosed within cartridges 20, modifications to the apparatus of U.S. Pat. No. 3,937,925 are provided to couple the drive motors to belts in the cartridge, and to sense various conditions of the cartridge.

At the beginning of a transaction, controller 21 operates to turn on separator motor 27, which continuously operates throughout the transaction. Clutch 23 and restraint motor 25 are operated by controller 21 as each individual sheet is to be delivered from cartridge 20 into transport 29, and then stopped when the document is sensed in transport 29. Such a delivery operation is inhibited by OR 31 when cartridge in place switch 156 signals that a cartridge of correct denomination is not in place in ATM 38 with an open issue port 76, or that cash out sensor 122 has been activated, as will be more fully described hereafter. Controller 21 is also responsive to a cash low signal from sensor 120 to signal the need for servicing of cartridge 20. Motor 27 operates through clutch 23 and coupling 228 to drive separator belt 54 inside of the cartridge, and motor 25 operates through coupling 272 to drive restaint belt 62—as will be described more fully hereafter.

Cartridge Housing Assembly

Figure 4:
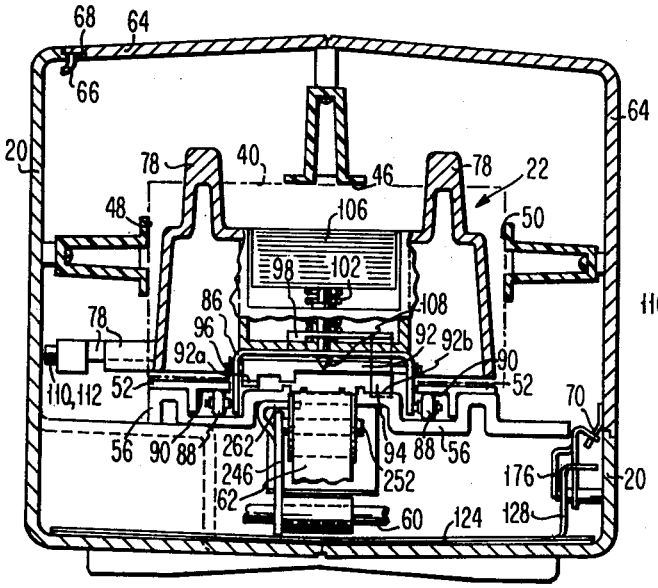
FIGS. 2–4 are front, top, and side sectional views of the cartridge of the invention.
Figure 2:
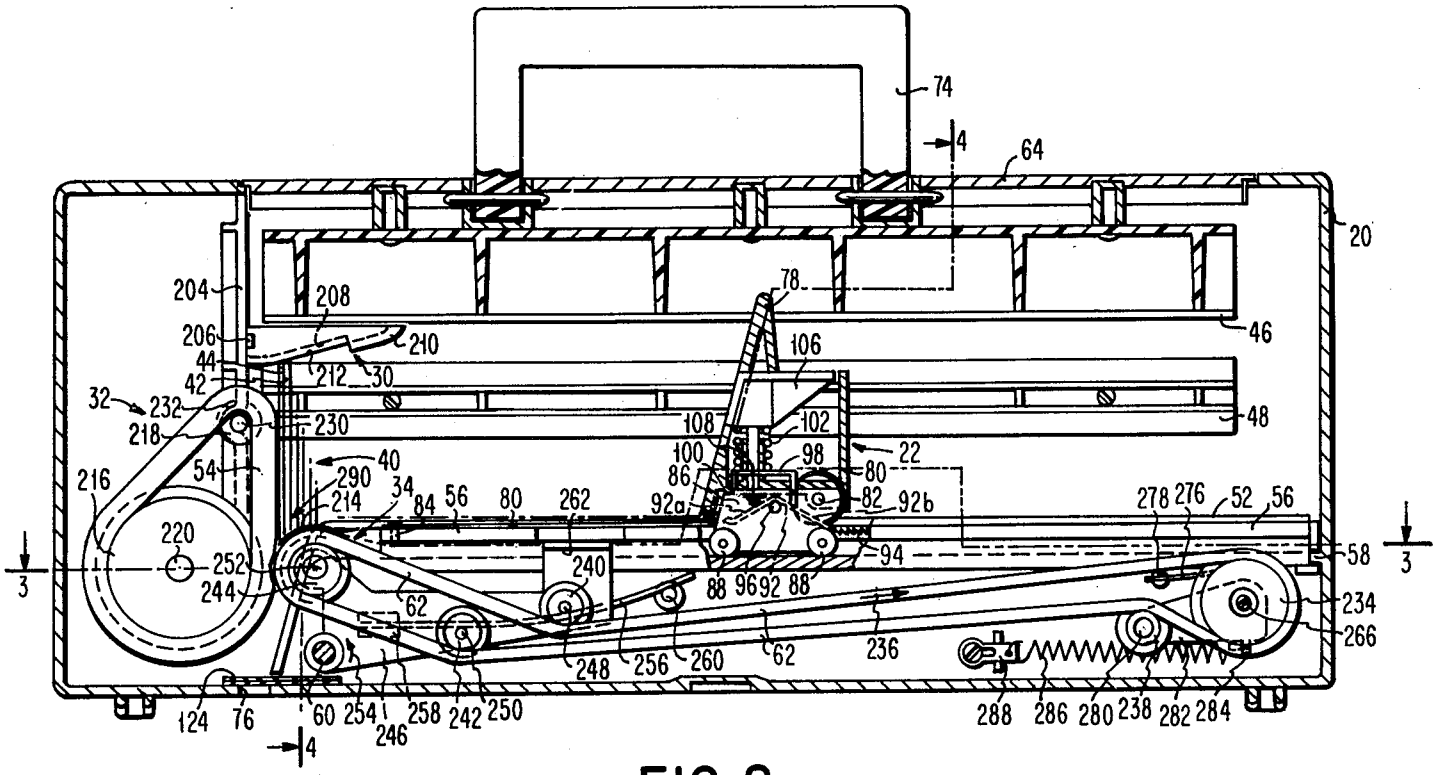
Figure 3:
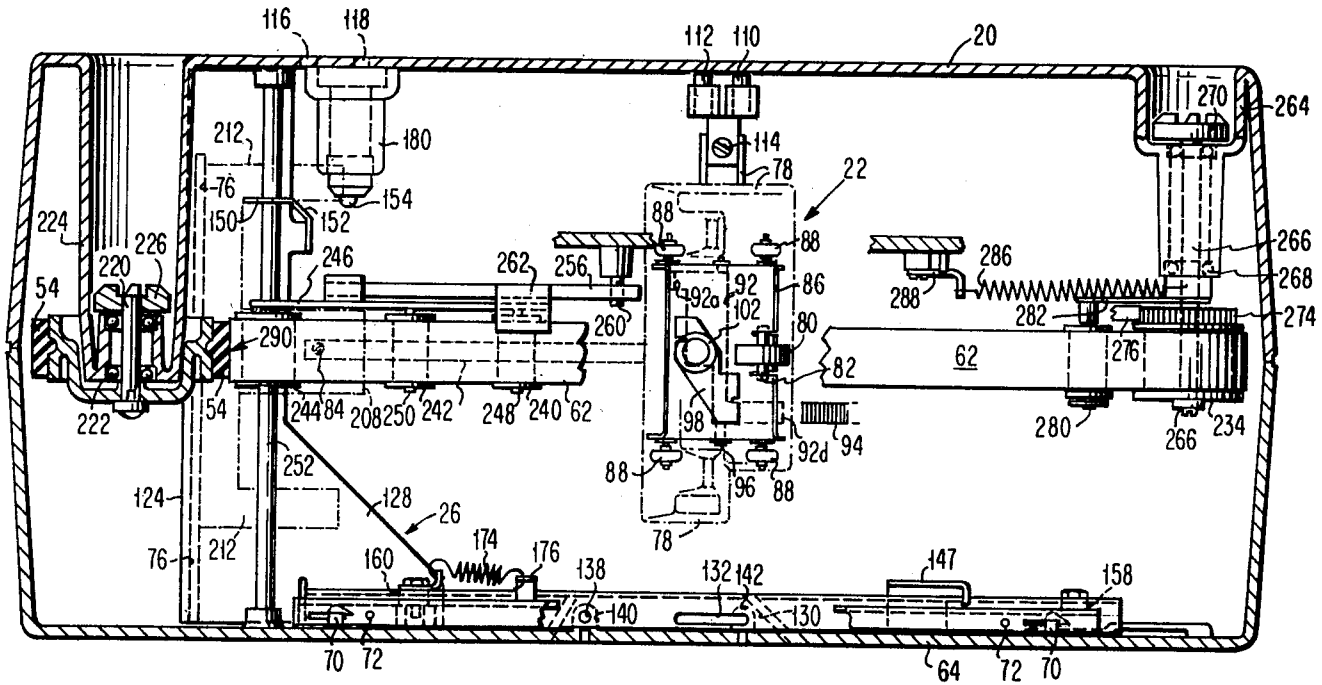

Referring now to FIGS. 2-4, cartridge housing 20 includes top, bottom, side and end walls for enclosing a stack of currency documents 40. Stack 40 is held securely within cartridge 20 by top guide rails 46, side guide rails 48, 50, document support plates 52, follower assembly 22, document metering device 30, and separator belt 54. Side plate 48 is fixedly attached to cartridge housing 20, and side plate 50 to cover 64, and dimensioned to accommodate the size of documents 40 for which the cartridge is personalized.

Document support plate 52 is fixedly attached to bottom plate 56. Bottom plate 56 is keyed to engage projections 58 on housing 20 and snaps over pivot 60, such that bottom plate 56 can be removed to expose restraint belt 62 for servicing.

Cover 64 forms a part of the top and of one side wall of cartridge housing 20. Offset tabs 66 in cover 64 engage slotted holes 68 in housing 20 to form a hinge about which cover 64 can be rotated to open cartridge 20 for insertion or removal of documents and servicing. Catches 70 are fixedly attached to cover sheet, as will be more fully explained hereafter. Handle 74 is mounted to cover 64 for use in transporting the cartridge to and from the terminal.

Documents are issued through feed slot 76 in the bottom wall of cartridge 20 into a transport for delivery to the customer.

Follower

Stack 40 of currency documents is urged into separator belt 54 by document support 78, which is actuated by constant force spring 80, assisted by the gravity force resulting from the mounting angle with respect to horizontal of cartridge 20 on housing base 38. Constant force spring 80 is coiled about shaft 82 in follower 22, lays along the top of bottom plate 56, and is attached thereto by mounting screw 84. Constant force spring 80 has the property that irrespective of the horizontal distance between shaft 82 and mounting screw 84, the force exerted by spring 80 urging shaft 82 in follower 22 toward separator belt 54 is substantially constant.

Document support 78 is fixedly attached to frame 86, to which are rotatably mounted wheels 88. Wheels 88 ride in a track between bottom plate 56 and surface 90 of document support plate 52, thus permitting movement of follower 22 along the longitudinal axis of the currency stack. Movement of follower 22 away from separator belt 54 is normally prevented by anti-backup pawl 92 in follower 22 engaging ratchet 94 in bottom plate 56.

Pawl 92 is mounted for rotation about pivot pin 96 in frame 86, and is normally urged into engagement with ratchet 94 by load beam 98, which pivots on follower frame 86 at point 100, and is loaded by spring 102 through hole 104 in frame 86 into engagement with leg 92*b*.

To release pawl leg 92*b* from ratchet 94, and permit follower 22 to be backed away from separator belt 54 for loading currency documents into stack 40, release button 106 is depressed. This forces projection 108 into engagement with leg 92*a*, rotating pawl 92 about pin 96, and out of ratchet 94, against the force of spring 102.

Documents 40 must be supplied to feed throat 290 with a constant and well controlled pressure. If the force is too high, documents 40 may block and fail to feed. If the force is too low, document 42 may fail to enter throat 290. To obtain the proper force condition, cartridge 20 is mounted in DFM 38 at angle 33 (FIG. 1) with respect to horizontal, such that support plate 52 slops down toward throat 290. Angle 33 is selected such that the component of document stack 40 weight in the direction of support 52 is equal to the friction force between stack 40 and plate 52. With angle 33 chosen to balance document stack 40 friction on support 52, constant force spring 80 forces document support 78 to urge document stack 40 against separator belt 54 with a force against separator belt 54 that is substantially constant and independent of the number of documents in stack 40. Also, the material selected for bottom plate 52 is selected such that the frictional force between plate 52 and documents 40 is substantially constant over a wide range of environmental (including document material, temperature and humidity) conditions. These conditions are substantially satisfied by using acetal homopolymer as the friction surface of bottom plate 52 and establishing angle 33 as 12°.

Cash Low/Cash Out Sensing

Figure 10:
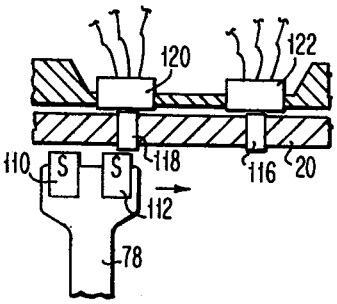
FIG. 10 is a schematic view of cash low/cash out sensing means of the invention.

Referring now to FIG. 10 in connection with FIG. 3, magnetic filed generators 110, 112 are mounted to document support 78 by screw 114 so as to traverse a path along the inside back wall of cartridge housing 20 as documents are issued from stack 40 and follower 22 moves toward separator belt 54. Flux concentrating slugs 116 and 118 are placed in the back wall of cartridge 20, along that path, and positioned to cooperate with magnets 110 and 112 to activate Hall Effect Sensors 120, 122 to generate signals representing a cash low condition and a cash out condition. A cash out condition exists when stack 40 contains insufficient documents to handle an expected transaction, and a cash low condition exists when stack 40 is sufficiently low that service personnel should be alerted to refresh the supply or exchange the cartridge for another one. Hall Effect Sensors 120 and 122 are mounted outside of cartridge 20 and in the frame of the machine so as to be in alignment with flux concentrators 116, 118 (soft iron slugs) in the wall of cartridge 20. As magnet 112 reaches flux concentrator 118, Hall Effect Sensor 120 is turned on to provide a cash low signal. Sensor 120 remains on (due to its inherent hysterisis and the field of magnet 110) until magnet 112 reaches flux concentrator 116 and switches on Hall Effect Sensor 122. The distance between concentrators 116 and 118 is larger than the distance between magnets 110 and 112. However, Hall Effect Sensor 120 will not switch off as magnet 110 passes by it due to its hysterisis (the flux required to turn it on is considerably more than the flux required to keep it on.) This permits the distance between cash low and cash out sensors 120, 122 to be related to the number of bills between those conditions, and yet cash low 120 will not switch off before cash out 122 is switched on.

Feed Door Assembly

Figure 6:
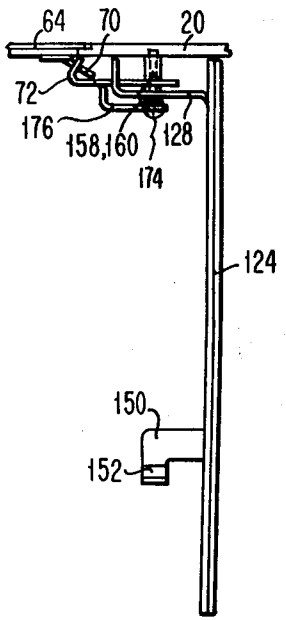
FIGS. 5–7 are drawings of the issue door and cover door latching and locking mechanisms of the cartridge.
Figure 5:
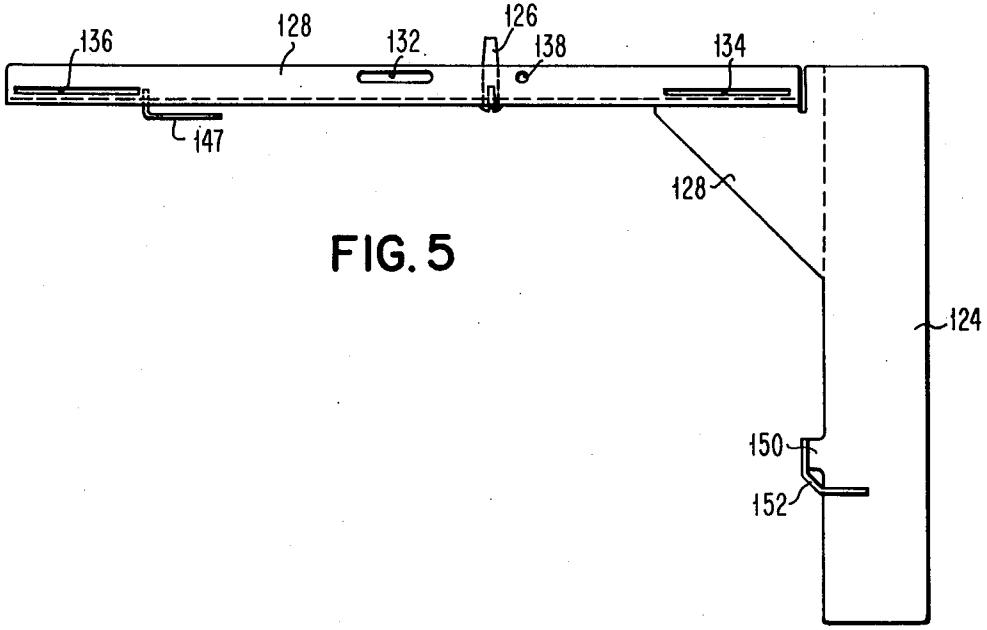
Figure 7:
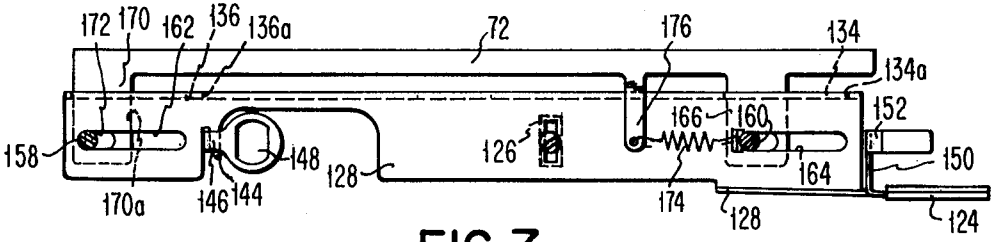

Referring now to FIGS. 5–7, in connection with FIGS. 2–4, feed slot 76 is blocked by door 124, which can be selectively positioned to closed and open positions by moving handle 126 on door extension 128 within recess 130 in cartridge housing 20.

Extension 128 has a number of slots 132, 134, and 136 and hole 138 for use in selectively locking door 124 shut over feed slot 76 and to an open position with selective locking or unlocking of cover 64.

With door 124 in the closed position, seal wire hole 138 is in position to receive a seal wire (not shown) through recess 140 in cartridge 20. That seal wire locks door 124 and also, as will be explained hereafter, cover 64. Seal wire slot 132 in door extension 128 is positioned to receive another seal wire (not shown) through recess 142 in cover 20, which will permit door 124 to move to an open position, but prevent the further movement required to unlatch cover 64.

Door extension 128 further includes lock tab 144 for engagement by key lock pawl 146 to lock door 124 in the fully closed position. Key lock 148 is fixedly attached in the side wall of cartridge housing 20.

Cartridge in place tab 150 on door 124 includes cam surface 152 for actuating plunger 154 to operate cartridge in place switch 156.

Door 124 is slidably attached by screw bushings 158 and 160 to housing 20. Slots 162 and 164 in door extension 128 engage bushings 158 and 160 respectively. In a similar manner, latch bar 72 is slidably attached to housing 20, with bushings 158 and 160 riding in leg slot 166, 168 and leg slot 170, 172. Spring 174 is attached to latch bar 72 at projection 176 and to the cartridge housing at bushing 160, to urge latch bar 72 in the latched, or closed position with hooks 70 of door 64 engaging slots in latch bar 72.

Leg 166 of latch bar 72 extends through slot 134 in door extension 128, and leg 170 through slot 136.

In operation, with both lock wires removed from hole 138 and slot 132 and key lock pawl 146 rotated out of engagement behind lock tab 144, both door 124 and cover 64 are opened as follows. Handle 126 in door extension 128 is manually moved to the left, as viewed in FIG. 5, (to right as in FIG. 1) opening door 124. During this movement, slots 162 and 164 of door extension 128 slide on bushings 158 and 160. Latch bar 72 remains stationary, held in the closed position by spring 174 with legs 166 and 170 riding in slots 134 and 136, respectively. Further movement of handle 126 to the left moves extension 128 sufficiently for surface **134*a* of slot 134 to engage surfaces 166*a* of leg 166 and carry latch bar 72 for the length of slots 168—sufficient for catches 70 to disengage the slots in latch bar 72 and permit cover 64** to be rotated open.

With a lock wire inserted through slot 132, as noted above, door extension 128 is able to move door 124 to an open position, but not sufficiently far for slot edge 134 to engage and move leg 166 to unlatch latch bar 72 from hooks 70.

With a lock wire inserted through hole 138, or key lock 146 engaging lock tab 144, door extension 128 cannot be moved, and door 124 covers feed slot 76, and cover 64 is locked shut, if then or subsequently closed.

Cartridge In Place/Denomination Keying

Figure 8C:
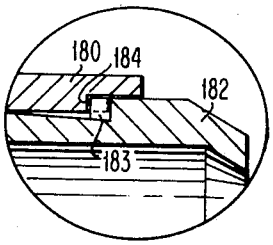
FIGS. 8A, 8B, and 8C are sectional views of the cartridge denomination key.
Figure 8A:
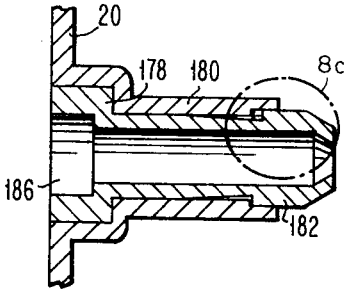
Figure 8B:
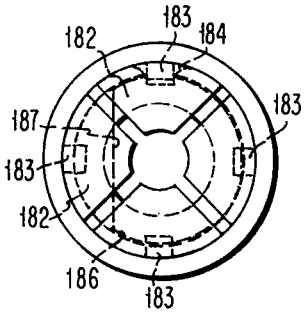

Referring now to FIGS. 8A, 8B, and 8C cartridge denomination key 178 is mounted in one of four radial positions within annular extension 180 of cartridge wall 20. Cartridge key 178 has four spring fingers 182, each including tab portion 183, one of which snaps into raised slot 184 in extension 180, to select one of four locked radial positions for key 178. Key 178 has a D hole 186 with flatted surface 187 adapted to receive a properly oriented DFM key 188, which includes flatted surface 190. The radial position of D hole 186 is changed by manually disengaging said one of spring fingers 182 from slot 184, and rotating key 178 to bring another one of spring fingers 182 into alignment with raised slot 184. In FIG. 8C, an enlarged detail is given for portion **8*c* of FIG. 8A**.

Figure 9:
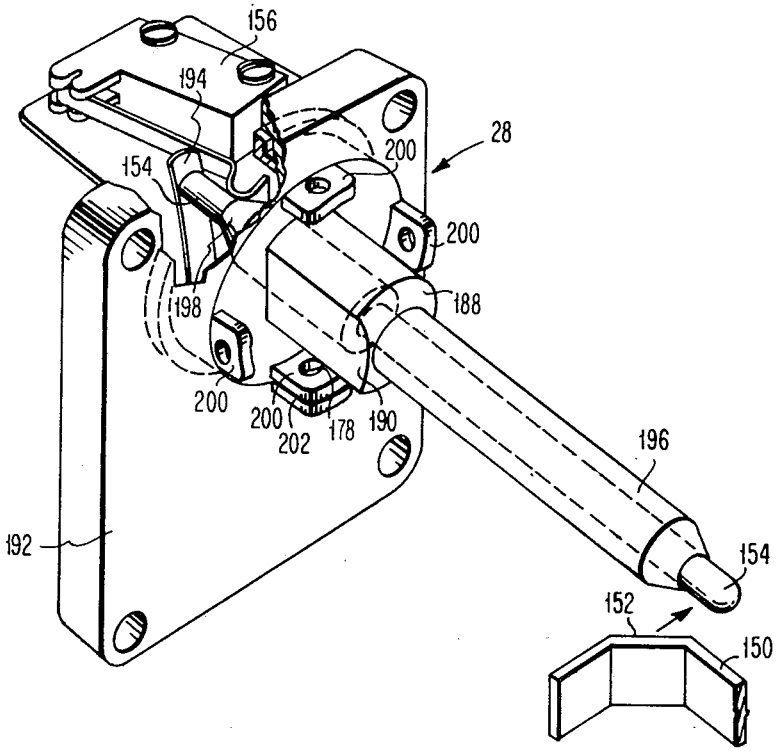
FIG. 9 is a partially cut away perspective view of the denomination key and cartridge in place with issue door open switch of the ATM.

Referring now to FIG. 9, in connection with FIG. 1, DFM key 188 is mounted to base 192, which forms a portion of the DFM wall, external to cartridge 20. Operating plunger 154 is loaded by spring 194 through an axial hole in key 188 and its extension 196. Switch 156 is mounted with its arm resting on plunger 154, which includes cam surface 198. As door 124 opens, plunger 154 is moved back against spring 194 by cam surface 152 on feed door tab 150 and cam 198 engages switch 156 to generate a contact closure signifying that cartridge 20 is in place and feed slot door 124 is in the open position.

DFM key 188 includes four radially positioned lock wire hole tabs 200, and is rotatable about the major axis of plunger 154 to bring one of lock wire hole tabs 200 into alignment with DFM lock wire hole tab 202 in wall 192. When thus positioned, flatted surface 190 is brought into radial alignment with the flatted portion of D hole 186 in a cartridge 20 keyed for the appropriate currency denomination. A lock wire may be inserted through hole 178 in hole tabs 200, 202 to discourage changing of the DFM denomination key 188.

Document Meter

Referring now to FIGS. 2 and 3, document meter 30 is mounted to front plate 204 by screw 206, and vertically adjusted when so mounted such that meter finger 208 surface 210 extends slightly lower than the top of stack 40. Document skew control guides 212 are thus positioned at both sides of the top of stack 40, to prevent skewing of the documents as they travel beyond document support plates 52 and ride on throat guide 214 into the bite between separator belt 54 and restraint belt 62. As documents are issued out of the cartridge, the differential pressure in the documents bearing against surface 210 and those closer to separator belt 54 increases until it is sufficient to cause a fiew documents to fall past surface 210 into the dispensing region under skew control guides 212. In this manner, the pressure on document 42 is not permitted to build up excessively, thereby making it difficult to separate endmost document 42 from next endmost document 44 by the coaction of separator belt 54 and restraint belt 62.

Separator Belt

Referring again to FIGS. 2 and 3, separator belt 54 is driven by drive pulley 216 and carried by idler pulley 218. Drive pulley 216 is mounted on shaft 220, which is rotatably mounted by bearings 222 within annular extension 224 of cartridge wall 20. Drive coupling 226 is also mounted to shaft 220, and adapted to be engaged by separator drive 228 in the document feed mechanism.

Idler pulley 218 is mounted for rotation about shaft 230, which is held within knotch 232 of front plate 204 by tension in separator belt 54. Front plate 204 is dimensioned to fit within cartridge 20 and is also held in place by belt 54 tension—or else mounted by screws (not shown).

Restraint Belt

Restraint belt 62 is driven by restraint belt drive pulley 234 in the direction of tension vector 236 about tension idler pulley 238, idler pulleys 240 and 242, and pinch roller 244. Idler pulleys 240 and 242 and pinch roller 244 are journaled to restraint arm 246 by shafts 248, 250, and 252, respectively. Restraint arm 246 is pivotably mounted to pivot shaft 60 in the wall of cartridge housing 20, and urged in the direction of arrow 254 by leaf spring 256 to load restraint belt 62 at pinch roller 244 into separator belt 54. Leaf spring 256 is fixedly attached to restraint arm 246 at mounting 258, and is spring loaded against reaction post 260 in cartridge housing 20. Release tab 262 on restraint arm 246 may be pushed downward through a hole in bottom plate 56 to rotate pinch roller 244 away from separator belt 54, thereby releasing for manual removal documents pinched between belts 54 and 62.

Restraint belt drive pulley 234 is journaled to annular extension 264 of cartridge housing 20 by drive shaft 266 and bearings 268. Drive coupling 270 is also mounted to drive shaft 266, and adapted to be engaged by restraint belt drive 272 in the document feed mechanism. Ratchet teeth 274 in drive pulley 234 are engaged by anti-backup pawl 276, which is attached to mounting boss 278 in the wall of cartridge 20.

Restraint belt tension idler pulley 238 is journaled to pulley shaft 280 on tensioner arm 282. Tensioner arm 282 is mounted for rotation about shaft 266 and includes hook 284. Spring 286 is attached to hook 284 and mounted to hook 288 on the wall of cartridge 20 to load pulley 238 into belt 62, as shown.

Tension vector 236 is restraint belt 62 passes through or beneath axis 60, thus reducing or counteracting the force tending to rotate pulley 244 away from separator belt 54 against the force of spring 256. (That force is due to tension in belt 62 between rollers 240 and 244.) In this manner, the forces in pinch area 290 aare calibrated to most effectively feed and separate documents from stack 40 through feed slot 76.

While the invention has been particularly shown and described with reference to preferred embodiments thereof, it will be understood by those skilled in the art that the foregoing and other changes in form and details may be made therein without departing from the spirit and scope of the invention.

We claim:

1. Apparatus for selectively storing and issuing currency sheets of a single predetermined denomination, comprising:
   - portable cartridge means for storing a stack of sheets and including means operable when in installed position for separating and delivering said sheets through an issue port when opened;
   - indicating means for indicating the intended predetermined denomination of sheets disposed within said cartridge;
   - drive means coupled to said cartridge means for selectively actuating said means for delivering when said issue port is opened;
   - first means for inhibiting said drive means when said issue port is closed;
   - second means for inhibiting said drive means when the stack of sheets is substantially exhausted; and
   - third means responsive to said indicating means for inhibiting the coupling of said drive means to the cartridge means when the cartridge means contains currency sheets not of the intended predetermined denomination.

2. The apparatus of claim 1, further comprising:
   - door means in a wall of said cartridge adapted when locked shut to block a cartridge loading aperture;
   - latch means adapted to be positioned selectively in a first position for latching shut both said door means and said issue port, in a second position for opening both said door means and issue port, and in a third position for opening said issue port while latching shut said door means;
   - first lock means for holding said latch means in said first position; and
   - second lock means operable when said first lock means is disengaged from said latch means for inhibiting motion of said latch means to said second position while enabling said latch means to be located selectively at said first and third positions.

3. Apparatus of claim 1 wherein said second means further comprises:
   - magnetic field generating means for generating a magnetic field representative of the location of the last bill to be fed from said stack;
   - field shunt means in a wall of said cartridge for directing said magnetic field to a position outside of said cartridge when said field generating means is located at a position corresponding to a substantially exhausted stack; and
   - magnetic transducer means outside said cartridge responsive to said magnetic field in said shunt means for cuasing said second means to inhibit said drive means when the stack of sheets is substantially exhausted.

4. Apparatus for delivering individual sheets from a stack to a sheet transport, comprising:

cartridge means for storing and transporting a stack of sheets, said cartridge means including drive means for engaging and feeding individual sheets from said stack through an issue port in a wall of said cartridge;

means coupled to said cartridge for actuating said drive means;

first door means in said cartridge adaptable to block said issue port;

means responsive to said first door means being in a blocking position for inhibiting said means for actuating;

second door means in a wall of said cartridge adapted when locked shut to block a cartridge load opening;

latch means adapted to be positioned selectively in a first position for latching shut both said door means, in a second position for opening both said door means, and in a third position for opening said first door means while latching shut said second door means;

first lock means for holding said latch means in said first position; and second lock means operable when said first lock means is disengaged from said latch means for inhibiting motion of said latch means to said second position while enabling said latch means to be located selectively at said first and third positions.

5. Apparatus for delivering individual sheets from a stack to a sheet transport, comprising:

cartridge means for storing and transporting a stack of sheets, said cartridge means including drive means for engaging and feeding individual sheets from said stack through an issue port in a wall of said cartridge;

means coupled to said cartridge for actuating said drive means;

sheet denomination indicating means in said cartridge means settable to one of a plurality of selectable positions for indicating the intended denomination of currency stored in said cartridge and to be dispensed therefrom;

means responsive to said indicating means being set at any except the selected position for preventing said cartridge means from being coupled to said means for actuating.

6. Apparatus for delivering individual sheets from a stack to a sheet transport, comprising:

cartridge means for storing and transporting a stack of sheets, said cartridge means including drive means for engaging and feeding individual sheets from said stack through an issue port in a wall of said cartridge;

means coupled to said cartridge for actuating said drive means;

stack feeding means in said cartridge for feeding said stack against said drive means with a substantially constant force;

field means in said stack feeding means for generating a magnetic field;

field shunt means in said cartridge for directing said magnetic field outside said cartridge to a first position when said stack feeding means has fed a predetermined proportion of said stack, and to a second position when said stack feeding means has fed substantially all of said stack to said drive means;

first magnetic transducer means at said first position responsive to said mgnetic field for signalling a stack low condition; and second magnetic transducer means at said second position responsive to said magnetic field for inhibiting said means for actuating.

7. Apparatus for storing and issuing document sheets or the like, comprising:

portable container means for holding completely enclosed within a lockable enclosure a stack of individual sheets;

transport means engaging said stack for delivering sheets through an issue port in said container means;

mounting means for holding said container;

drive means coupled to said transport means when said container means is mounted to said mounting means for driving said transport means;

door means positionable between opened and closed positions with said drive means operatively coupled to said transport means for selectively blocking said issue port; and means sensing the position of said door means when the container means is mounted to said mounting means with the drive means operatively coupled to the transport means for selectively enabling operation of said drive means when the door means does not block said issue port and for inhibiting said drive means when the door means does block said issue port.

8. Apparatus for storing and issuing currency sheets or the like into a document transport, comprising:

cartridge means for holding a plurality of individual sheets in a stack;

keying means in said cartridge settable to a position indicative of a predetermined intended characteristic of said sheets;

delivery means in said cartridge for separating individual sheets from said stack and delivering them through an issue port in said cartridge;

door means for selectively blocking said issue port;

mounting means for holding said cartridge with said issue port adjacent said document transport;

drive means in said mounting means adapted to engage said delivery means; and means responsive to said keying means and said door means for enabling said drive means to engage and operate said delivery means;

whereby said drive means will be operable to cause dispensing of sheets only of a predetermined intended characteristic from a cartridge that is properly positioned on said mounting means with the issue port unblocked.

9. Apparatus for delivering individual currency sheets to a sheet transport, comprising:

cartridge means for transporting and storing a stack of sheets and including means for engaging and delivering individual sheets from said stack through an issue port in said cartridge;

blocking means positionable between open and closed positions for selectively blocking said issue port;

sensing means for sensing when the supply of sheets in said stack in substantially exhausted;

drive means adapted to be coupled to said cartridge means irrespective of the position of said blocking means for selectively actuating said means for engaging and delivering; and means actuated by said blocking means and responsive to said sensing means for enabling said drive means only when said issue port is opened and said stack of sheets is not exhausted.

10. Apparatus for selectively delivering individual sheets, comprising:

cartridge means for storing and transporting a stack of sheets, said cartridge further comprising:

an issue port and door through which individual sheets may be delivered when the door is open;

stack feed means for feeding said stack towards said issue port;

sheet feed means for separating individual sheets from said stack and delivering them through said issue port;

a magnetic element carried by said stack feed means;

characteristic key means for identifying an intended characteristic of said sheets;

sheet transport means for holding said cartridge means and receiving individuals sheets issued out of said port, said transport means further comprising:

drive means coupled to said cartridge means for selectively actuating said sheet feed means;

means responsive to said issue door being closed for inhibiting said drive means;

Hall Effect means responsive to said magnetic element being fed to a cash out location for inhibiting said drive means;

means responsive to at least one setting of said characteristic key means for preventing said drive means from being coupled to said cartridge means and actuating said sheet feed means.

11. For use in an apparatus for delivering individual sheets of a predetermined intended denomination to a terminal having a drive actuating means, a cartridge comprising:

housing means for storing and transporting a stack of sheets;

drive means for engaging and feeding individual sheets from said stack through an issue port in a wall of said housing means; and sheet denomination indicating means settable to one of a plurality of selectable positions for indicating the intended denomination of sheets stored in said housing means and to be dispensed therefrom;

said denomination indicating means including means for enabling coupling of said housing means to said drive actuating means only when set to a position corresponding to said predetermined intended denomination.

12. The apparatus of claim 1 wherein said third means prevents installation of a cartridge having said indicating means set to indicate the denomination intended to be disposed within said cartridge is not said predetermined denomination, thereby preventing coupling of said drive means to said cartridge means.

13. The cartridge of claim 11, further comprising blocking means positionable between opened and closed positions for selectively blocking said issue port;

cover means positionable between opened and closed positions for selectively blocking a housing load opening; and latch means positionable selectively in a first position for latching shut both said blocking means and said cover means, in a second position for opening said cover means, and in a third position for opening said blocking means while latching shut said cover means.

14. The cartridge of claim 11, further comprising:

stack feeding means for feeding said stack against said drive means with a substantially constant force; and field means for generating a magnetic field indicative of the location of said stack feeding means.

15. The cartridge of claim 14, further comprising: field shunt means for shunting said magnetic field outside said housing means to a first position when said stack feeding means is at a location corresponding to a first predetermined portion of said stack, and to a second position when said stack feeding means is at a location corresponding to a second predetermined portion of said stack.

* * * * *